United States Patent [19]

Kato

[11] Patent Number: 5,071,273

[45] **Date of Patent: * Dec. 10, 1991**

[54] APPARATUS AND METHOD FOR CONTROLLING PAPER FEEDING IN A PRINTER

[75] Inventor: Takashi Kato, Suwa, Japan

[73] Assignee: Seiko Epson Corporation, Tokyo, Japan

[ * ] Notice: The portion of the term of this patent subsequent to Jun. 19, 2007 has been disclaimed.

[21] Appl. No.: 537,192

[22] Filed: Jun. 12, 1990

Related U.S. Application Data

[63] Continuation of Ser. No. 192,024, May 9, 1988, Pat. No. 4,934,845.

[30] Foreign Application Priority Data

May 13, 1987 [JP] Japan ..... 62-116284

[51] Int. Cl.[5] ..... B41J 11/42

[52] U.S. Cl. ..... 400/582; 400/708; 400/630

[58] Field of Search ..... 400/351, 582, 630, 708

[56] References Cited

U.S. PATENT DOCUMENTS 4,272,204 6/1981 Quinn, Jr. et al. .
4,487,517 12/1984 Ozawa et al. .
4,540,299 9/1985 Yamada .
4,778,288 10/1988 Nakamura .
4,800,402 1/1989 Lake, Jr. et al. .
4,934,845 6/1990 Kato ..... 440/582

FOREIGN PATENT DOCUMENTS 158993 12/1980 Japan .
136281 8/1984 Japan .
9792 1/1985 Japan .
217186 10/1985 Japan .
41066 2/1987 Japan .

*Primary Examiner*—J. Reed Fisher
*Assistant Examiner*—John S. Hilten
*Attorney, Agent, or Firm*—Blum Kaplan

[57] ABSTRACT

An apparatus for determining the print region for individual sheets of paper for use in a printer is provided. A paper sheet feeder for feeding the individual sheets of paper is supported on the printer. A sensor detects the presence of a sheet of paper fed by the paper sheet feeder. A microprocessor measures the length of the individual sheet of paper based upon the detection from the detector and provides a measurement value. The microprocessor computes the size of a possible print region of each sheet paper based upon this measurement value and displays the size of a possible print region on a display. Memory associated with the printer stores the size of the possible print region for setting the internal condition of the printer upon the introduction of power to the printer.

5 Claims, 3 Drawing Sheets

APPARATUS AND METHOD FOR CONTROLLING PAPER FEEDING IN A PRINTER

This is a continuation of application Ser. No. 07/192,024 filed May 9, 1988, now U.S. Pat. No. 4,934,845.

BACKGROUND OF THE INVENTION

The present invention relates generally to an apparatus and method for controlling paper feeding in a printer, and, in particular, to an apparatus and method for controlling the paper sheet feeder of a printer utilizing signals from a paper presence detecting sensor.

In a conventional printer it is not possible to print characters on all of the lines extending from the upper edge of each individual sheet to the bottom edge of each individual sheet. This arises because positioning and placing of the individual sheet is insufficient at the extreme top and extreme bottom of each individual sheet to allow accurate printing. This results in a limited printing range which excludes several lines at the top and several lines at the bottom of each individual sheet. Conventional printing outside the print region results in lines of inferior print quality.

Accordingly, printing with the conventional printer necessitates confirmation and pre-setting of the print region prior to printing if an individual sheet feeder is used. When the print position becomes lower than the lower edge of the print region, the individual sheet is ejected and a new individual sheet is introduced to the printer. The lower end of the print region is determined as either a predetermined printing position or a position determined based upon signals from a paper detecting sensor located in the printer corresponding to an earlier detected paper position. Furthermore, when characters are printed on individual sheets utilizing software in conjunction with a personal computer, such as a word-processor (hereinafter referred to as application software), it is necessary to input the number of possible print lines with respect to the size of each individual sheet. Accordingly, in a conventional personal computer printer, the paper feeding condition is controlled by this inputted value.

In conventional sheet feed devices, printing problems will occur when there is a difference between the length of page controlled by the application software, in other words the length of the calculated print region and the actual length of the page controlled by the printer. Such a condition results in a failure to eject the individual sheet at the correct position and at the correct time.

The page length may be preliminarily set for the printer; however, once power is introduced to the printer, the set page length must generally be maintained. The maintained page length value is almost longer than the actual length of the individual sheet. Therefore, the value for the page length must be determined and controlled by a signal from a paper detecting sensor. However, the use of conventional paper detecting sensor mechanisms result in variations of the calculated page length value due to inaccuracies use of the paper feeder mechanism, inaccuracies of the paper detecting sensor and variations of the size of individual sheets.

Accordingly, it is desired to provide an individual sheet feeding mechanism which overcomes the disadavantages of the prior art devices described above by synchronizing the page length value controlled by the printer with the page length value controlled by the application software.

SUMMARY OF THE INVENTION

Generally speaking, in accordance with the present invention, an apparatus having an improved individual sheet feeding structure, and a corresponding method are provided. A printer feeding individual sheets includes an individual sheet feeder. A paper detecting sensor detects the passage of the paper as it is fed from the individual sheet feeder and produces a signal in response thereto. A microprocesser is provided for receiving this information and calculating the size of the print region. A display displays the calculated value. A storage apparatus stores the print region value to be used as the initial set value of the page length.

The page length is first measured utilizing the paper feeding apparatus and signals produced by the paper detecting sensor. If a single sized individual sheet is used, a possible variation amount is subtracted from the measured page length of the individual sheet thereby producing a maximum value for the possible print region with respect to all of the individual sheets to be processed. This obtained maximum value is then stored in a storage apparatus to be used as an initial set value for page length once the power is initially applied to the printer. The page length is also displayed to the user so that the page length may be inputted in connection with the application software.

Accordingly, it is an object of this invention to provide improved feeding of individual sheets through a printer.

Another object of this invention is to provide a sheet feeder for a printer which synchronizes the page length control of the printer with the page length control of the application software.

Yet another object of the invention is to provide a feeder for individual sheets in a printer which limits the inaccuracy of the paper feeding mechanism.

A further object of the invention is to provide an individual sheet feeder for a printer which limits the variations in print quality due to the accuracy of the paper detecting sensor.

Still another object of the invention is to provide an individual sheet feeder for a printer which may accommodate a variety of sizes of individual sheets without a loss of print accuracy.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
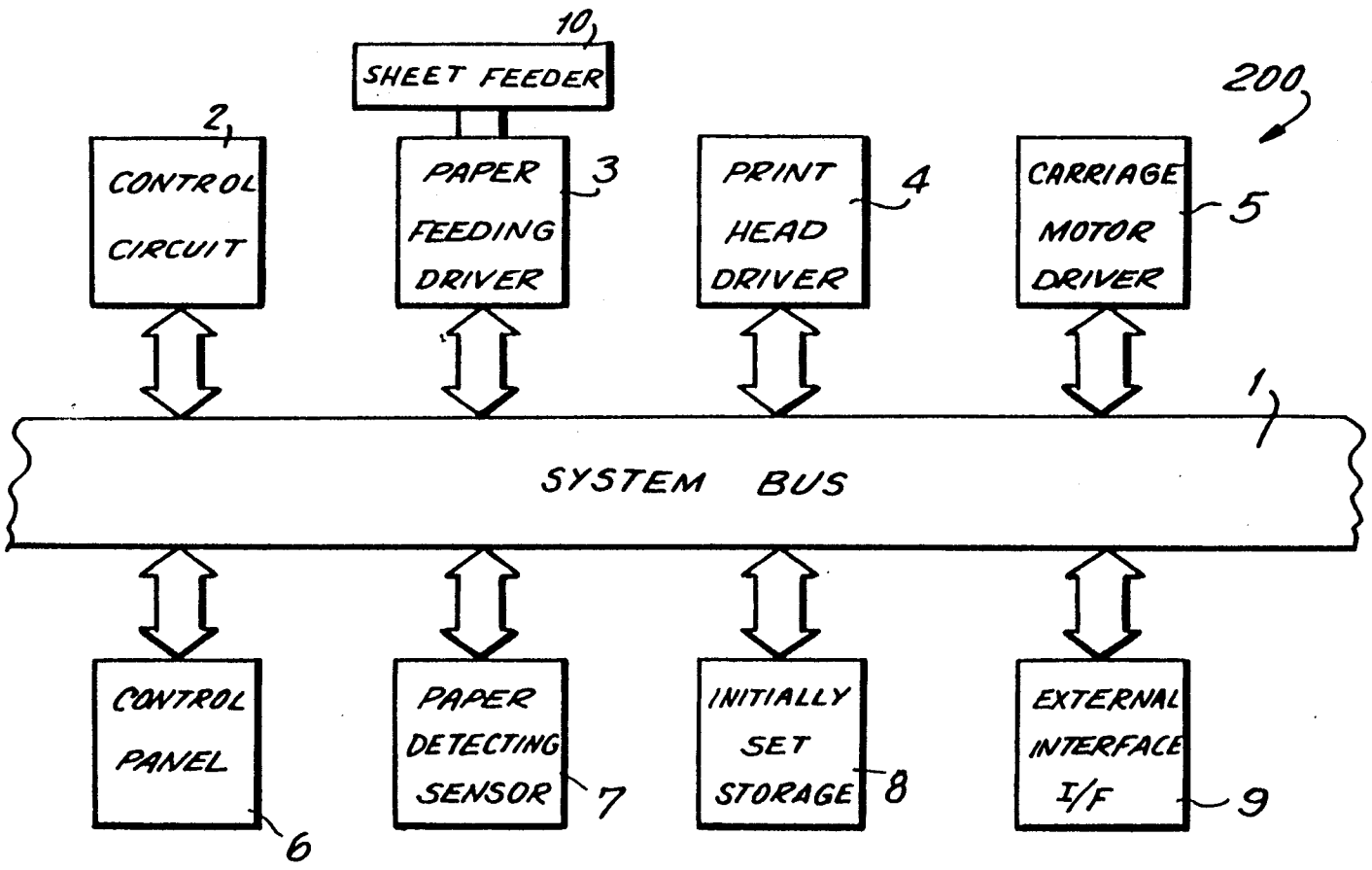
FIG. 1 is a block diagram of a printer in accordance with the invention.
Figure 2:
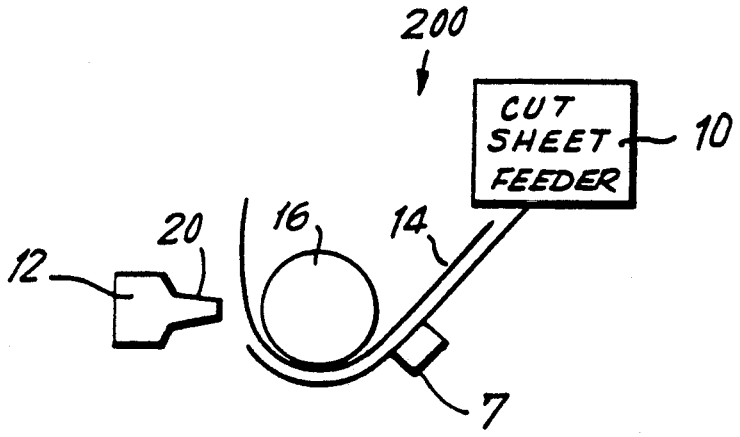
FIG. 2 is a schematic side elevational view of the printer in accordance with the invention.

Reference is first made to FIGS. 1 and 2 of the drawings wherein a printer for feeding individual sheets and printing thereon, generally indicated at 200, and constructed in accordance with the present invention, is depicted. Printer 200 includes a system bus 1 which interconnects a control circuit 2 to each element of printer 200. Control circuit 2 includes a microprocessor unit for controlling printer 200. A paper feeding driver 3 is coupled to control circuit 2 through system bus 1 and includes a paper feeding motor and driving circuit for controlling the paper feeding motor. Paper feeding driver 3 also controls a cut or individual sheet feeder 10 which feeds individual sheets 14 through printer 200. A print head driver 4 including a print head 12 and circuitry for driving head 12 is controlled by control circuit 2 through system bus 1. A carriage motor driver 5 includes a carriage motor and driving circuit for driving the carriage motor and is also controlled by control circuit 2 through system bus 1.

A control panel 6 for setting control circuit 2 is coupled to control circuit 2 through bus 1. Control panel 6 is provided with easily usable switches for inputting a paper offset factor. A paper detecting sensor 7 for detecting the presence of an individual sheet of paper 14 is coupled to control circuit 2 through bus 1. A storage apparatus 8 includes a switch group for pre-setting an initial condition of the paper feed control when power is introduced to printer 200. An external interface 9 couples a host computer to this printer 200 and receives data from the computer.

Operation of printer 200, as shown in FIG. 2, commences when an individual sheet 14 is introduced from individual sheet feeder 10 and passes over paper detecting sensor 7. Printing is conducted by printing head 12. Individual sheet feeder 10 is driven by paper feed driver 3.

Figure 3:
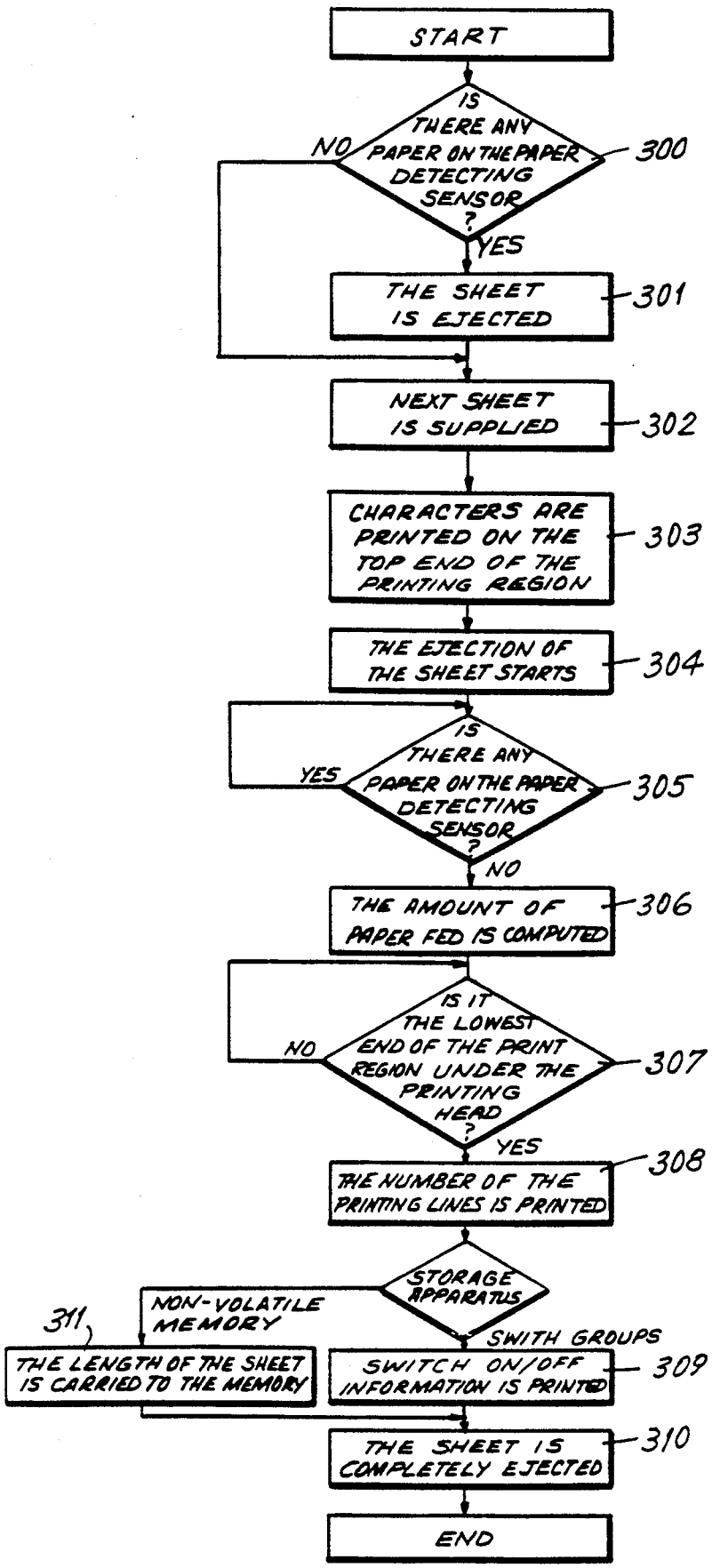
FIG. 3 is a flow chart illustrating the steps for feeding individual sheets of paper in accordance with the invention.

Reference is now made to FIG. 3 wherein operation of printer 200 in accordance with the invention is demonstrated through a flow chart.

Printer 200 measures an individual sheet 14 upon the pushing of a switch of control panel 6 introducing power to printer 200. In accordance with a first step 300, paper detecting sensor 7 detects the presence or absence of an individual sheet 14 and produces a signal in accordance therewith. If paper is present, sheet 14 is ejected in accordance with step 301. If no paper is detected by sensor 7, for example, after ejection, then, in accordance with step 302 a new sheet 14 is supplied. The supplying of sheet 14 by sheet feeder 10 is complete when the upper end of sheet 14 passes over sensor 7 and under foot 20 of print head 12. In accordance with a step 303, characters are printed on the first line corresponding to the uppermost line of the print region. A drive roller 16 then sequentially rotates paper 14 out of printer 200 during the ejection of individual sheet 14 by drive roller 16. Paper detecting sensor 7 eventually detects the trailing edge of sheet 14. However, paper detector 7 is continuously detecting the presence or absence of paper in accordance with step 305. Step 305 is repeated until no paper is detected by detector sensor 7. When no paper is detected by paper detector 7 in accordance with step 305, the amount of paper fed from the first detection of paper until the complete ejection of sheet 14 is computed in accordance with step 306.

As can be seen in FIG. 2, sheet 14 travels a distance between detecting sensor 7 and print head 12 which corresponds to a print area on sheet 14. It is possible to print after detection of the trailing edge of sheet 14 by detector 7 and prior to the complete ejection of sheet 14 by roller 16. When the bottom edge of the print region of sheet 14 has arrived below foot 20 of print head 12, paper feeding is stopped in accordance with step 307. The length of sheet 14 is determined by the amount of paper fed and detected by detecting sensor 7 and a computed value is printed on sheet 14 in accordance with step 308.

Figure 4:
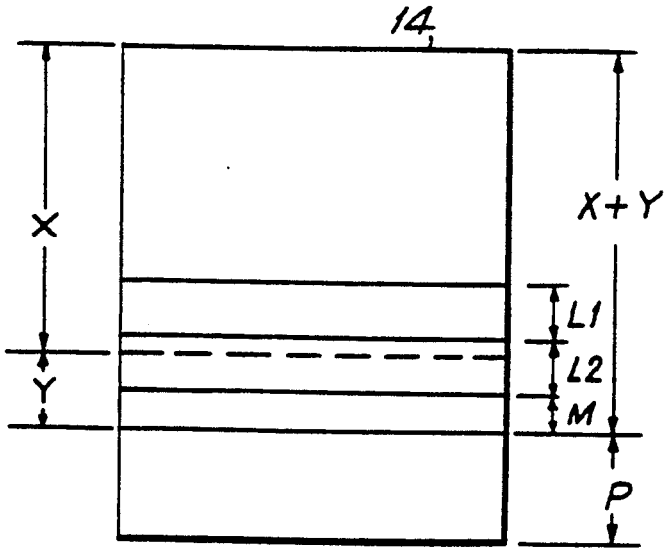
FIG. 4 is an illustration of an individual sheet of paper marked in the quadrants utilized to describe the effects of the present invention.

Reference is now made to FIG. 4 wherein an individual sheet 14 is depicted. The information printed on sheet 14 in accordance with step 308 consists of two types of information. The first type of information corresponds to a calculated value of the number of print lines on individual sheet 14 computed on the assumption that each print line has a height of one sixth of an inch (1/6"). The second type of information printed on sheet 14 corresponds to the switch position information for storing the page length of that individual sheet 14 in the switch groups of storage 8. In this second type, the page length is represented in a binary fashion through the on/off positioning of the switches. The computed value of the number of lines per sheet determined in the first type of information reflects a measured result determinable and usable by the application software. The amount of paper fed past the print head 12 between the detection of the leading edge of sheet 14 and the trailing edge of sheet 14 is represented by a region X. The length of remaining print region which passes the print head 12 after detection of the trailing edge of sheet 14 is represented by a region Y. The size of region Y does not depend on the individual sheet. A provisional page length is equal to the sum of X and Y. The sum is divided by one sixth of an inch to obtain a quotient and remainder corresponding to the possible number of lines which may be fit within the determined page length. Where the remainder is larger than a maximum value based upon the variety of the calculated page lengths for individual sheets, an additional line is added to the quotient. This value is then printed as the number of lines which may be printed on an individual sheet 14. Additionally, the actual page length of sheet 14 is the product of this possible print line number and one sixth of an inch.

The second type of information represents information utilized by the user to manually set the switches in storage 8. If non-volatile memory is provided in printer 200, the information concerning the possible print region is stored in the non-volatile memory without the need to print the information of the switch groups. The description below is made in reference to a printer not having non-volatile memory.

The most frequently used individual sheet sizes are A4, B5 or letter size. Each has a known print area line value. B5 has 57 lines of available print region, letter size has 61 lines of available print region and A4 paper has an available print region of 65 lines When 56 lines is regarded as a standard page size, each line count may be represented as some additional value corresponding to the difference between 56 lines and a number of print lines of that particular sized sheet of paper. This difference in line number may be represented by a binary number of four digits corresponding to four switches of storage 8. B5 would need an additive factor of plus one to arrive at 57 print lines on B5 paper. This additive factor is represented by the binary number 0001. Letter size paper, having 61 possible print lines, requires an additive factor of plus five which is represented by binary number 0101, and A4 paper, having 65 lines, requires an additive factor of plus 9 which is represented by binary number 1001.

In accordance with a step 309 shown in FIG. 3, the on/off print information is printed so that the user may set the appropriate switches of storage 8. For the case of A4 sized paper, the print out would be "On Off Off On" corresponding to switches 4 through 1 respectively. Accordingly, the user would set switch 4 "on", switch 3 "off", switch 2 "off" and switch 1 "on" to indicate that nine extra lines are available for printing on A4 paper. The user would then set the switches of storage 8 accordingly. In a printer having nonvolatile-memory, the storage information would not be printed in accordance with step 311.

When four digit binary numbers, in other words four switch groups, are utilized, the possible print region is limited to 57 through 71 lines. If the paper length falls out of this range, the binary number 0000 is adopted. This sets a relatively large length of sheet size upon the introduction of power to the printer 200. As long as the set value for page length determined by the application software is not transmitted to printer 200, the possible print region is defined solely by signals from paper detecting sensor 7.

Once the above data has been printed, control circuit 2 sends a signal to paper feed driver 3 causing sheet 14 to be ejected in accordance with a step 310.

Once the switches of storage apparatus 8 have been set by the user, or after the page length has been stored in the memory of a non-volatile memory, the page length is set within the printer upon introduction of power to printer 200. Once the user inputs the number of lines printed to the application software, the page length controlled by the application software coincides with the page length controlled by printer 200.

Detecting when the uppermost end of the possible print region of sheet 14 is under foot 20 of print head 12 is obtained by feeding paper sheet 14 until the amount of sheet 14 fed beyond paper detecting sensor 7 is equal to a predetermined value at least equal to the distance between sensor 7 and print head 12. Similarly, in accordance with step 305, to detect when the bottom end of the possible print region of sheet 14 is below print head 12, a predetermined amount of sheet 14 is fed after the paper detecting sensor 7 detects the bottom edge of sheet 14.

Regions X and Y correspond to the basic possible print region. When a line within the print region has a height of one sixth of an inch and the remaining lines for example L1, L2 each have a length of one sixth of an inch respectively, a surplus region M will result within the print region. Even though the basic print region is shown as the sum of the regions X and Y, characters may be printed on a line within region M as long as the height of M is not equal to zero. Accordingly, even if the height of region M is less than one sixth of an inch, an additional line may be printed below $L_2$ and the uppermost end of that additional printed line will be included in the print region. However, when printing in region M, care must be taken due to the variation in determination of sheet size due to measurement error. If the value of region M exceeds the maximum variation and region M is identified so that it is not the cause of any error, one additional line may be printed in an area P.

Accordingly, by providing a control for the software print page value and the hardware print page value based upon the same computations, a paper sheet feed device which does not result in a difference in the control of page length by the printer and the software is provided. The length of the page is computed based upon the amount of paper fed while a paper detecting sensor detects the introduction and ejection of individual sheets of paper.

It will thus be seen that the objects set forth above, among those made apparent from the preceding description are efficiently attained and, since certain changes may be made in carrying out the above method and in the construction set forth without departing from the spirit and scope of the invention, it is intended that all matters contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An apparatus for determining the possible print region of individual sheets of paper for use in a printer comprising paper sheet feeder means for feeding said individual sheets of paper to the printer in a paper feed direction, sensor means for detecting the presence of a sheet of paper fed by the paper sheet feeder means, measuring means for measuring the length of an individual sheet of paper by feeding a first sheet of paper and sensing the presence of paper until the full length of the paper has been ejected from the printer and measured and providing a measurement value in response thereto, computing means for computing the size of a possible print region of each sheet of paper based upon the measurement value corresponding to the entire length of the sheet of paper, printing means for printing the computed size of the possible print region, the sensor means being positioned upstream in the paper feed direction from the print means, the print means printing the computed size of the print region onto the sheet of paper when the sheet of paper has completely passed the sensor means so that the full length of said paper is ejected by the paper sheet feeder means; and storage means for storing the size of the possible print region and setting the operating parameters of the printer when power is introduced to the printer, and when printing is to occur on a sheet of paper, said paper sheet feeder means moving said sheet of paper to a predetermined position in accordance with said operating parameter of the printer.

2. A method for controlling the feeding of individual sheets of paper to a print means in a printer having a paper presence detector, a sheet feeder and a print head, the paper presence detector being positioned upstream in a paper feed direction of the print mans, comprising the steps of detecting the presence of a first sheet of paper fed by the sheet feeder, measuring the length of the individual sheet by feeding the first sheet of paper and continuously detecting the presence of the first sheet of paper until the first sheet of paper has been ejected from the printer and providing a measurement value, computing the size of a possible print region for each sheet of paper based upon the measurement value corresponding to the entire length of the first sheet of paper, printing the computed size of the possible print region on the sheets of paper when the first sheet of paper has passed the paper presence detector, ejecting the printed sheet of paper, storing the size of the possible print region and setting the operating parameters of the printer in accordance with the stored value when power is introduced to the printer, and when printing is to occur on a sheet of paper, feeding said sheet of paper to a predetermined position in accordance with said operating parameter of the printer.

3. A method for controlling the feeding of individual sheets of paper in a printer having a paper presence detector, sheet feeder and a print head, the paper presence detector being positioned upstream in a paper feed direction of said print head comprising the steps of switching the power on while controlling the specific switches for placing the printer in a measuring mode, initially detecting the presence of a sheet of paper on the paper presence detector, ejecting the initial sheet of paper from the printer if detected, supplying a sheet of paper from the sheet feeder, feeding the supplied sheet through the printer, detecting the leading edge of the sheet, detecting the trailing edge of the sheet, computing the amount of paper fed from the first detection of the sheet until the last detection of the sheet, computing a print region for the paper, printing the computed print region size on the sheet when the sheet has passed the paper presence detector, ejecting the sheet from the printer, setting the internal value of the printer to correspond to the printed value, storing the setting, and switching the power on without controlling said specific switches and printing on a successive sheet in accordance with said computed print region.

4. An apparatus for determining the possible print region of individual sheets of paper for use in a printer comprising paper sheet feeder means for feeding said individual sheets of paper to the printer in a paper feed direction, sensor means for detecting the presence of a sheet of paper fed by the paper sheet feeder means, measuring means for measuring the length of an individual sheet of paper by feeding a first sheet of paper and sensing the presence of paper until the full length of the paper has been ejected from the printer and measured and providing a measurement value in response thereto, computing means for computing the size of a possible print region of each sheet of paper based upon the measurement value corresponding to the entire length of the sheet of paper, printing means for printing to display the computed size of the possible print region, the sensor means being positioned upstream in the paper feed direction from the print means, the print means printing the computed size of the print region onto the sheet of paper when the sheet of paper has completely passed the sensor means so that the full length of said paper is ejected by the paper sheet feeder means; and storage means for storing the size of the possible print region and setting the operating parameters of the printer when power is introduced to the printer, and when printing is to occur on a sheet of paper, said paper sheet feeder means moving said sheet of paper to a predetermined position in accordance with said operating parameter of the printer.

5. A method for controlling the feeding of individual sheets of paper to a print means in a printer having a paper presence detector, a sheet feeder and a print head, the paper presence detector being positioned upstream in a paper feed direction of the print means, comprising the steps of detecting the presence of a first sheet of paper fed by the sheet feeder, measuring the length of the individual sheet by feeding the first sheet of paper and continuously detecting the presence of the first sheet of paper until the first sheet of paper has been ejected from the printer and providing a measurement value, computing the size of a possible print region for each sheet of paper based upon the measurement value corresponding to the entire length of the first sheet of paper, printing the computed size of the possible print region on the sheets of paper to display the computed size of the possible print region when the first sheet of paper has passed the paper presence detector, ejecting the printed sheet of paper, storing the size of the possible print region and setting the operating parameters of the printer in accordance with the stored value when power is introduced to the printer, and when printing is to occur on a sheet of paper, feeding said sheet of paper to a predetermined position in accordance with said operating parameter of the printer.

* * * * *